US012583030B2

(12) United States Patent
Li

(10) Patent No.: US 12,583,030 B2
(45) Date of Patent: Mar. 24, 2026

(54) REGENERATION TREATMENT METHOD OF WASTE SHELL-MOLD AND SYSTEM THEREOF

(71) Applicant: Leelink Resource Technology Co., Ltd, Houlong Township, Miaoli County (TW)

(72) Inventor: Tsung-Chi Li, Zhubei (TW)

(73) Assignee: Leelink Resource Technology Co., Ltd, Miaoli Country (TW)

( * ) Notice: Subject to any disclaimer, the term of this patent is extended or adjusted under 35 U.S.C. 154(b) by 402 days.

(21) Appl. No.: 18/329,889

(22) Filed: Jun. 6, 2023

(65) Prior Publication Data

US 2024/0066524 A1 Feb. 29, 2024

(30) Foreign Application Priority Data

Aug. 26, 2022 (TW) ..... 111132383

(51) Int. Cl.
*B22C 5/06* (2006.01)
*B22C 5/04* (2006.01)

(52) U.S. Cl.
CPC . *B22C 5/06* (2013.01); *B22C 5/04* (2013.01)

(58) Field of Classification Search
CPC .... B22C 5/02; B22C 5/04; B22C 5/06; B07B 9/00
USPC ..... 209/127.3
See application file for complete search history.

(56) References Cited

U.S. PATENT DOCUMENTS

2023/0219852 A1* 7/2023 Tiner ..... C04B 33/14 501/150
2023/0415167 A1* 12/2023 Nieminen ..... B22C 5/06

FOREIGN PATENT DOCUMENTS

CN 112844760 A * 5/2021 ..... C04B 35/04

* cited by examiner

*Primary Examiner* — Michael Mccullough
*Assistant Examiner* — Jessica L Burkman
(74) *Attorney, Agent, or Firm* — MUNCY, GEISSLER, OLDS & LOWE, P.C.

(57) ABSTRACT

A regeneration treatment method of waste shell-mold and a system thereof are provided. The regeneration treatment method has a raw smashing step, a smashed-particle sieving step smashed-particle, a first magnetic separation step, a grinding step, a second magnetic separation step, a dry pneumatic flotation step, and a vibration sieving step in sequence to obtain a regenerated shell-mold sand. The refined shell-mold sand is obtained from the smashed-particle sieving step. Silica binders of the refined shell-mold sand is effectively removed by the grinding step. Furthermore, particle sizes of the regenerated shell-mold sand fall in a suitable range in the grinding step. Magnetic metals mixed in the waste shell-mold are effectively removed by the first and second magnetic separation steps. Non-magnetic impurity are further removed by the dry pneumatic flotation step. Therefore, the regenerated shell-mold sand are suitable to substitute original shell-mold sand.

20 Claims, 9 Drawing Sheets

REGENERATION TREATMENT METHOD OF WASTE SHELL-MOLD AND SYSTEM THEREOF

CROSS-REFERENCE TO RELATED APPLICATIONS

This application is based upon and claims priority under 35 U.S.C. 119 from Taiwan Patent Application No. 111132383 filed on Aug. 26, 2022, which is hereby specifically incorporated herein by this reference thereto.

BACKGROUND OF THE INVENTION

1. Field of the Invention

The present invention is related to a regeneration treatment method of waste shell-mold and system of waste, more particularly to a regeneration treatment method and system thereof for regenerating waste shell-mold obtained from an investment casting process as regenerated shell-mold sand.

2. Description of the Prior Arts

An investment casting process is a casting method. A shell-mold made of a mixture of shell-mold sand and silica binders is used to coat on a pre-formed wax mold matching a shape of a desired cast. The wax mold is dewaxed to form a mold cavity in the shell-mold, then a melted metal is cast in the mold cavity. After the metal is cooled down and solidified, the shell-mold is shattered to remove the shell-mold and to obtain the metal cast. At this time, because a waste shell-mold becomes into broken pieces and shell-mold sand of the waste shell-mold is coated by the silica binders, the broken pieces of the waste shell-mold are useless and need be discarded and buried. However, as the environmental awareness grows, the cost of burying the waste shell-mold increases day by day. Therefore, the waste shell-mold needs to be regenerated as regenerated shell-mold sand to allow a reuse in the original casting process.

With reference to FIG. 9, a conventional treatment system of waste shell-mold includes a smashing unit 91, a humidity control module 92, a stripping unit 93, and a sieve 94. The smashing unit 91, the humidity control module 92, the stripping unit 93, and the sieve 94 are arranged in sequence. The smashing unit 91 includes two smashing wheels 911. The stripping unit 93 includes a barrel 931 and a shaft 932. The shaft 932 is mounted through the barrel 931 and has two vanes 933. The barrel 931 has an inner wall and two convex ribs 934. The convex ribs 934 are formed around the inner wall of the barrel 931 corresponding to the vanes 933. As shown in FIG. 9, the conventional treatment system regenerates waste shell-molds 90 as regenerated shell-mold sand. Because the waste shell-molds 90 are a waste material obtained from the investment casting process, magnetic metal particles (such as the iron) and non-magnetic impurity particles (such as the stainless steel, the titanium, or the aluminum, the zircon sand, and so on) are mixed in the waste shell-molds 90. In the conventional treatment system, the waste shell-molds 90 are first introduced into the smashing unit 91 and is pre-smashed into waste shell-mold fragments 901, which are easier to be treated. Then, the waste shell-mold fragments 901 are dried by the humidity control module 92. The stripping unit 93 receives the waste shell-mold fragments 901 obtained from the smashing unit 91. After the rotary vanes 933 inside the stripping unit 93 hit the waste shell-mold fragments 901, the waste shell-mold fragments 901 are struck to the convex ribs 934 to further rub against the silica binders accumulated between the convex ribs 934. The silica binders are peeled off from a surface of each waste shell-mold fragment 901, then regenerated shell-mold sand particles 902 are formed. Finally, the regenerated shell-mold sand particles 902 are sifted out by the sieve 94 to separate regenerated shell-mold sand and waste shell-mold residue 903 from the waste shell-mold particles 902.

However, the conventional treatment system is not only unable to separate magnetic particles mixed in the waste shell-mold sand but also incapable to separate non-magnetic impurity particles effectively. Furthermore, the vanes of the stripping unit directly hit the waste shell-mold fragments so that the waste shell-mold fragments are smashed into powders with too small particle size. Additionally, powders of the regenerated shell-mold sand mixed with exceeding impurity particles are unable to substitute original shell-mold sand. Therefore, the conventional treatment system needs to be improved.

SUMMARY OF THE INVENTION

In view of the conventional treatment system of waste shell-mold sand is unable to separate magnetic particles mixed in the waste shell-mold sand, is incapable to separate the non-magnetic impurity particles effectively, and the waste shell-mold sand fragments are smashed into powders with too small particle sizes. An objective of the present invention is to provide a regeneration treatment method of waste shell-mold and system thereof.

To achieve the objection as mentioned above, the regeneration treatment method of waste shell-mold includes steps of:

(a) raw smashing waste shell-molds into raw shell-mold sand;

(b) sifting out refined shell-mold sand from the raw shell-mold sand, wherein particle sizes of the refined shell-mold sand fall within a first particle size range;

(c) removing magnetic metal particles mixed in the refined shell-mold sand;

(d) whirling and grinding the refined shell-mold sand by colliding with each other to remove silica binders adhered to surfaces of the refined shell-mold sand to obtain a shell-mold sand granular material;

(e) removing magnetic metal powders mixed in the shell-mold sand granular material;

(f) removing non-magnetic impurity mixed in the shell-mold sand granular material during the shell-mold sand granular material blown by an airflow to separate regenerated shell-mold sand from the shell-mold sand granular material; and (g) rolling the regenerated shell-mold sand on a metal sieve to remove dust adsorbed on the regenerated shell-mold sand by the static electricity and to collect the regenerated shell-mold sand remaining on the metal sieve.

The advantages of the present invention are described as follows. The grinding step involves whirling the refined shell-mold sand and grinding each refined shell-mold sand by colliding with each other to effectively remove the silica binders adhered to surfaces of refined shell-mold sand in a low-stress grinding manner. Thus, the particle sizes of the refined shell-mold sand is kept within the certain and suitable particle size range. In other words, the particle sizes of the refined shell-mold sand is not excessively decreased. Furthermore, the two magnetic separation steps are carried out before and after the grinding step to effectively remove the magnetic metal particles mixed in the refined shell-mold sand and magnetic metal powders mixed in the shell-mold sand granular material. Moreover, the dry pneumatic flotation step further separates the non-magnetic impurity from the shell-mold sand granular material to obtain the regenerated shell-mold sand. Accordingly, the regeneration treatment method in accordance with the present invention effectively removes the magnetic metals and the non-magnetic impurity mixed in the regenerated shell-mold sand obtained thereby. Additionally, the particle sizes of the regenerated shell-mold sand approach the original shell-mold sand. Thus, the regenerated shell-mold sand may substitute the original shell-mold sand. The recovery rate of the regenerated shell-mold sand is thus enhanced.

In addition, the present invention also provides the regeneration treatment system of waste shell-mold including:

- a smasher for smashing waste shell-molds into raw shell-mold sand;
- a sieving machine connected to the smasher for receiving the raw shell-mold sand obtained from the smasher and for sifting out refined shell-mold sand from the raw shell-mold sand; wherein particle sizes of the refined shell-mold sand fall within a first particle size range;
- a first magnetic separator connected to the sieving machine for receiving the refined shell-mold sand sifted out by the sieving machine and for removing magnetic metal particles mixed in the refined shell-mold sand;
- a grinder connected to the first magnetic separator, comprising at least one grinding chamber for receiving and whirling the refined shell-mold sand, wherein the refined shell-mold sand are ground by colliding to each other in the at least one grinding chamber to remove silica binders adhered to surfaces of the refined shell-mold sand and to obtain a shell-mold sand granular material;
- a second magnetic separator connected to the grinder for receiving the shell-mold sand granular material and for removing magnetic metal powders mixed in the shell-mold sand granular material;
- a dry pneumatic flotation machine connected to the second magnetic separator, comprising a floatation chamber for receiving the shell-mold sand granular material, for removing non-magnetic impurity particles mixed in the shell-mold sand granular material, and for blowing away non-magnetic impurity powders mixed in the shell-mold sand granular material by an airflow in the flotation chamber to obtain regenerated shell-mold sand; and
- a rotary vibration sieving machine connected to the dry pneumatic flotation machine, comprising a metal sieve for receiving the regenerated shell-mold sand, and for rolling the regenerated shell-mold sand on the metal sieve to remove dust adsorbed on the regenerated shell-mold sand by the static electricity and to collect the regenerated shell-mold sand remaining on the metal sieve.

With the foregoing description, the regeneration system of waste shell-mold sand mainly involves whirling the refined shell-mold sand and grinding each refined shell-mold sand by colliding with each other by the grinder to remove silica binders adhered to the surface of each refined shell-mold sand in a low-stress manner. The particle sizes of the refined shell-mold sand is kept within the certain and suitable particle size range and is not excessively decreased. Furthermore, the first and second magnetic separators remove the magnetic metal particles mixed in the refined shell-mold sand and the magnetic metal powders mixed in the shell-mold sand granular material. Moreover, the dry pneumatic flotation machine further removes the non-magnetic impurity particles and the non-magnetic impurity powders mixed in the shell-mold sand granular material. Accordingly, the regeneration treatment system in accordance with the present invention effectively removes the magnetic metals and the non-magnetic impurity mixed in the waste shell-mold sand. Additionally, the particle sizes of the regenerated shell-mold sand are similar to the original shell-mold sand. Thus, the regenerated shell-mold sand may substitute the original shell-mold sand. The recovery rate of the regenerated shell-mold sand is thus effectively enhanced.

DETAILED DESCRIPTION OF THE EMBODIMENTS

Figure 1:
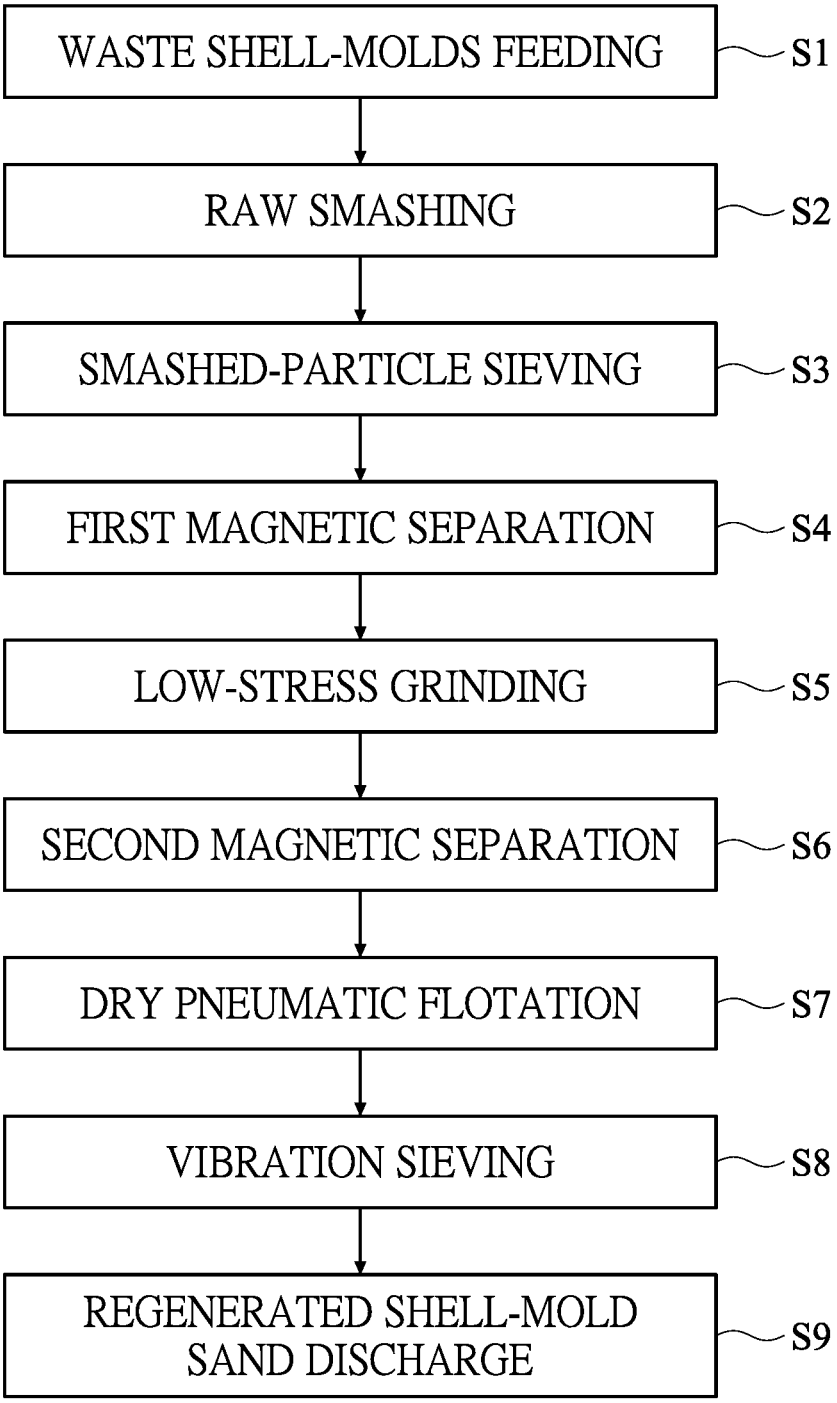
FIG. 1 is a flowchart of a regeneration treatment method of waste shell-mold in accordance with the present invention.

With reference to FIG. 1, a flowchart of the regeneration method of waste shell-mold in accordance with the present invention shows that the regeneration method of waste shell-mold comprises steps S1 to S9 as follows.

First, a waste shell-molds feeding step S1 is carried out to obtain waste shell-molds. In one embodiment, the waste shell-molds are a waste material obtained from the investment casting process. The waste shell-molds include shell-mold sand. The shell-mold sand is coated by silica binders. Magnetic metal particles and non-magnetic impurity particles are mixed in the waste shell-molds.

After the waste shell-mold feeding step S1 is finished, a raw smashing step S2 is carried out. In the step S2, the obtained waste shell-molds are smashed into raw shell-mold sand. The magnetic metal particles and the non-magnetic impurity particles originally embedded in the waste shell-molds are separated from the waste shell-molds and mixed with the raw shell-mold sand.

After the raw smashing step S2 is finished, a smashed-particle sieving step S3 is carried out. Because the raw shell-mold sand obtained from the raw smashing step S2 has uneven particle sizes, refined shell-mold sand is sifted rom the raw shell-mold sand and has particle sizes falling within a suitable particle size range. In one embodiment, the suitable particle size range is between 4 mm to 6 mm, but is not limited thereto. Additionally, since a particle size of each magnetic metal particle and each non-magnetic impurity particle mixed in the raw shell-mold sand is less than the suitable particle size range, the magnetic metal particles and the non-magnetic impurity particles are not separated and are still mixed in the refined shell-mold sand in the step S3.

After the smashed-particle sieving step S3 is finished, a first magnetic separation step S4 is carried out. In the step S4, the magnetic metal particles mixed in the refined shell-mold sand are removed by an external magnetic force.

After the first magnetic separation step S4 is finished, a grinding step S5 is carried out. In the step S5, the refined shell-mold sand is blown upward by an ascending airflow to whirl the refined shell-mold sand and grind the refined shell-mold sand by colliding with each other. The silica binders adhered to the surface of the refined shell-mold sand are thus removed to obtain a shell-mold sand granular material. In one embodiment, the step S5 may further include a plurality of grinding procedures to further grind and remove edges and corners on the surfaces of the refined shell-mold sand while the silica binders are removed. Therefore, a final shape of the shell-mold sand granular material is relatively round. Furthermore, since the grinding procedures whirl the refined shell-mold sand and grind the refined shell-mold sand by colliding with each other with a low-stress grinding, the particle sizes of most of the refined shell-mold sand are kept in the suitable particle size range. In one embodiment, the step S5 includes four grinding procedures, but is not limited thereto. Moreover, in the step S5, powders of the silica binders which are ground therefrom, slight powders of the shell-mold sand, and a small amount of the magnetic metal powders are still generated and mixed in the shell-mold sand granular material. A small part of the non-magnetic impurity particles are also ground into non-magnetic impurity powders which are still mixed in the shell-mold sand granular material.

After the grinding step S5 is finished, a second magnetic separation step S6 is carried out. In the step S6, the magnetic metal powders mixed in the refined shell-mold sand are removed by the external magnetic force.

After the second magnetic separation step S6 is finished, a dry pneumatic flotation step S7 is carried out. In the step S7, the non-magnetic impurity mixed in the shell-mold sand granular material is removed during the shell-mold sand granular material is blown by an airflow. Regenerated shell-mold sand is separated from the shell-mold sand granular material. The non-magnetic impurity includes non-magnetic impurity particles and non-magnetic impurity powders. In the step S7, the regenerated shell-mold sand and the non-magnetic impurity particles are separated from a difference in the density therebetween. The regenerated shell-mold sand and the non-magnetic impurity powders are separated from a difference in the particle sizes therebetween. In other words, when the shell-mold sand granular material is blown by the airflow, the non-magnetic impurity particles having the larger density is not blown by the airflow and is removed while the regenerated shell-mold sand with suitable density is blown and floated in the air. The non-magnetic impurity powders having the less particle sizes are further blown away from the regenerated shell-mold sand and move along the airflow direction, and may be further removed by a powder collection process. In one embodiment, the shell-mold sand granular material is moved horizontally during the shell-mold sand granular material is blown by an oblique airflow. The regenerated shell-mold sand floating in the air is easier to collect. The non-magnetic impurity may include the stainless steel, the titanium, or the aluminum, the zircon sand, and so on, but is not limited thereto. Finally, the regenerated shell-mold sand is separated.

After the dry pneumatic flotation step S7 is finished, a vibration sieving step S8 is carried out. In the step S8, the regenerated shell-mold sand is driven to gyrate and roll down on a metal sieve to facilitate the full contact between the regenerated shell-mold sand with the metal sieve. The static electricity is removed. The dust absorbed on the regenerated shell-mold sand by the static electricity is removed. The regenerated shell-mold sand remaining on the metal sieve is collected. In one embodiment, the step S8 may include a plurality of vibration sieving procedures. The vibration sieving procedures use the metal sieves with different mesh sizes. The mesh sizes of the metal sieves are arranged from large to small according to the order in which the vibration sieving procedures are carried out. For example, the step S8 may include four vibration sieving procedures. The mesh sizes of the metal sieves decrease according to the first vibration sieving procedure to the fourth vibration sieving procedure to collect the regenerated shell-mold sand having the particle size within a first particle size range to a fourth particle size range.

In one embodiment, the first vibration sieving procedure collects the regenerated shell-mold sand having the particle sizes that fall within a first particle size range. The first particle size range is between the mesh size of the metal sieve applied in the first vibration sieving procedure and a maximum of the suitable particle size range which is 6 mm. The second vibration sieving procedure collects the regenerated shell-mold sand having the particle sizes that fall within a second particle size range. The second particle range is between the mesh size of the metal sieve applied in the second vibration sieving procedure and the mesh size of the metal sieve applied in the first vibration sieving procedure. The third vibration sieving procedure collects the regenerated shell-mold sand having the particle sizes that fall within a third particle size range. The third particle range is between the mesh size of the metal sieve applied in the third vibration sieving procedure and the mesh size of the metal sieve applied in the second vibration sieving procedure. The fourth vibration sieving procedure collects the regenerated shell-mold sand having the particle sizes that fall within a fourth particle size range. The fourth particle range is between the mesh size of the metal sieve applied in the fourth vibration sieving procedure and the mesh size of the metal sieve applied in the third vibration sieving procedure.

After the vibration sieving step S8 is finished, a regenerated shell-mold sand discharge step S9 is carried out. In the step S9, the generated shell-mold sand collected in the vibration sieving step S8 and remaining on the metal sieve is introduced into a storage barrel. In one embodiment, the four vibration sieving procedures collect the regenerated shell-mold sand having different particle sizes. The average granularities of the regenerated shell-mold sand having the particle sizes that falls within the first particle size range to the fourth particle size range may be 22S, 35S, 60S and 70S respectively, but the average granularities of the regenerated shell-mold sand are not limited to the value described above.

In conclusion, the first magnetic separation step S4 effectively removes the magnetic metal particles mixed in the refined shell-mold sand. The grinding step S5 effectively remove the silica binders adhered to the surface of the refined shell-mold sand and further grinds and removes the edges and corners on the surface of the refined shell-mold sand. Therefore, the shell-mold sand granular material having a round shape is obtained. The second magnetic separation step S6 effectively removes the magnetic metal powders mixed in the refined shell-mold sand. The dry pneumatic flotation step S7 effectively removes the non-magnetic impurity particles and the non-magnetic impurity powders by blowing the shell-mold sand granular material to obtain the regenerated shell-mold sand so that the water and surfactants are not necessary, which are usually used in a conventional flotation step. Wastewater and pollutants are not generated. The vibration sieving step S8 facilitates the full contact between the regenerated shell-mold sand and the metal sieve. The static electricity is removed. The dust absorbed on surfaces of the regenerated shell-mold sand by the static electricity is removed.

Therefore, the regenerated shell-mold sand obtained from the regeneration treatment method as described has advantages as follows. The residual metals and impurities are low. The regenerated shell-mold sand having the round shape is easier to disintegrate after the metal cast is formed. A residual dust is low so an air permeability is high to prevent air bubbles from forming in the metal cast. Then the yield of the metal cast is improved. Thus, the regenerated shell-mold sand may substitute the original shell-mold sand.

The regeneration treatment system of waste shell-mold sand in accordance with the present invention is further introduced as follows. With referenced to FIG. 2, the regeneration treatment system comprises a smasher 20, a sieving machine 30, a first magnetic separator 40, a grinder 50, a second magnetic separator 60, a dry pneumatic flotation machine 70, and a rotary vibration sieving machine 80 arranged in sequence.

The smasher 20 is used for smashing obtained waste shell-molds 10 into raw shell-mold sand 11. The waste shell-molds 10 include shell-mold sand. The shell-mold sand is coated by silica binders. In one embodiment, the smasher 20 may be a drum type smasher. The drum type smasher has a smashing drum 21 including a waste shell-mold inlet 211 and raw shell-mold sand outlet 212. The waste shell-mod inlet 211 is designed for the waste shell-mold 10 to be fed into the smashing drum 21. The raw shell-mold sand outlet 212 is designed for the raw shell-mold sand 11 to leave the smashing drum 21. A direction of an opening of the waste shell-mold inlet 211 and a direction of an opening of the raw shell-mold sand 212 are vertical to each other. Accordingly, the waste shell-mold sand 10 is fed into the smashing drum 21 through the waste shell-mold inlet 211 and is smashed into the raw shell-mold sand 11. Then, the raw shell-mold sand 11 leaves the smashing drum 21 through the raw shell-mold sand outlet 212. After smashing, magnetic metal particles 15 and non-magnetic impurity particles are mixed in the raw shell-mold sand 11. The magnetic metal particles 15 and the non-magnetic impurity particles leave the smashing drum 21 through the raw shell-mold sand outlet 212 with the raw shell-mold sand 11.

The sieving machine 30 comprises a perforated sieve plate 31 to receive the raw shell-mold sand 11 obtained from the smasher 20. Because the raw shell-mold sand 11 obtained from the smasher 20 has uneven particle sizes, the sieving machine 30 sifts out refined shell-mold sand 12 from the raw shell-mold sand 11 having the particle sizes that fall within a suitable particle size range. In one embodiment, the suitable particle size range is between 4 mm to 6 mm, but is not limited thereto. Additionally, the magnetic metal particles 15, magnetic metal powders, and the non-magnetic impurity particles and powders mixed in the raw shell-mold sand 11 having relatively small particle sizes are not separated and still mixed in the refined shell-mold sand 12.

The first magnetic separator 40 receives the refined shell-mold sand 12 sifted out by the sieving machine 30. The first magnetic separator 40 generates magnetic force to remove the magnetic metal particles 15 mixed in the refined shell-mold sand 12. In one embodiment, the first magnetic separator 40 has an electromagnetic 41 mounted therein to provide the magnetic force to remove the magnetic metal particles 15, but is not limited thereto.

Figure 2:
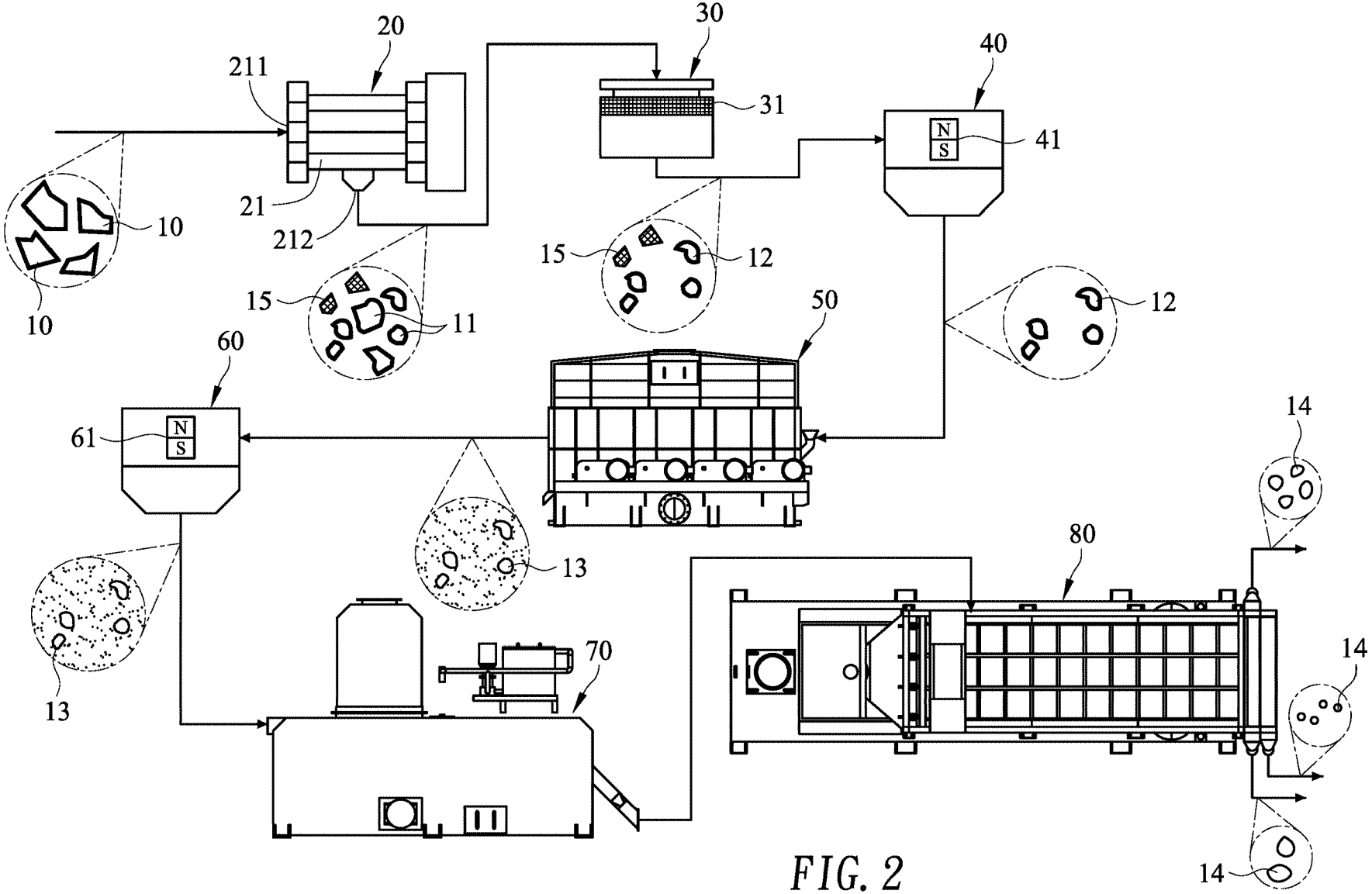
FIG. 2 is a system diagram of a regeneration treatment system of waste shell-mold in accordance with the present invention.
Figure 3:
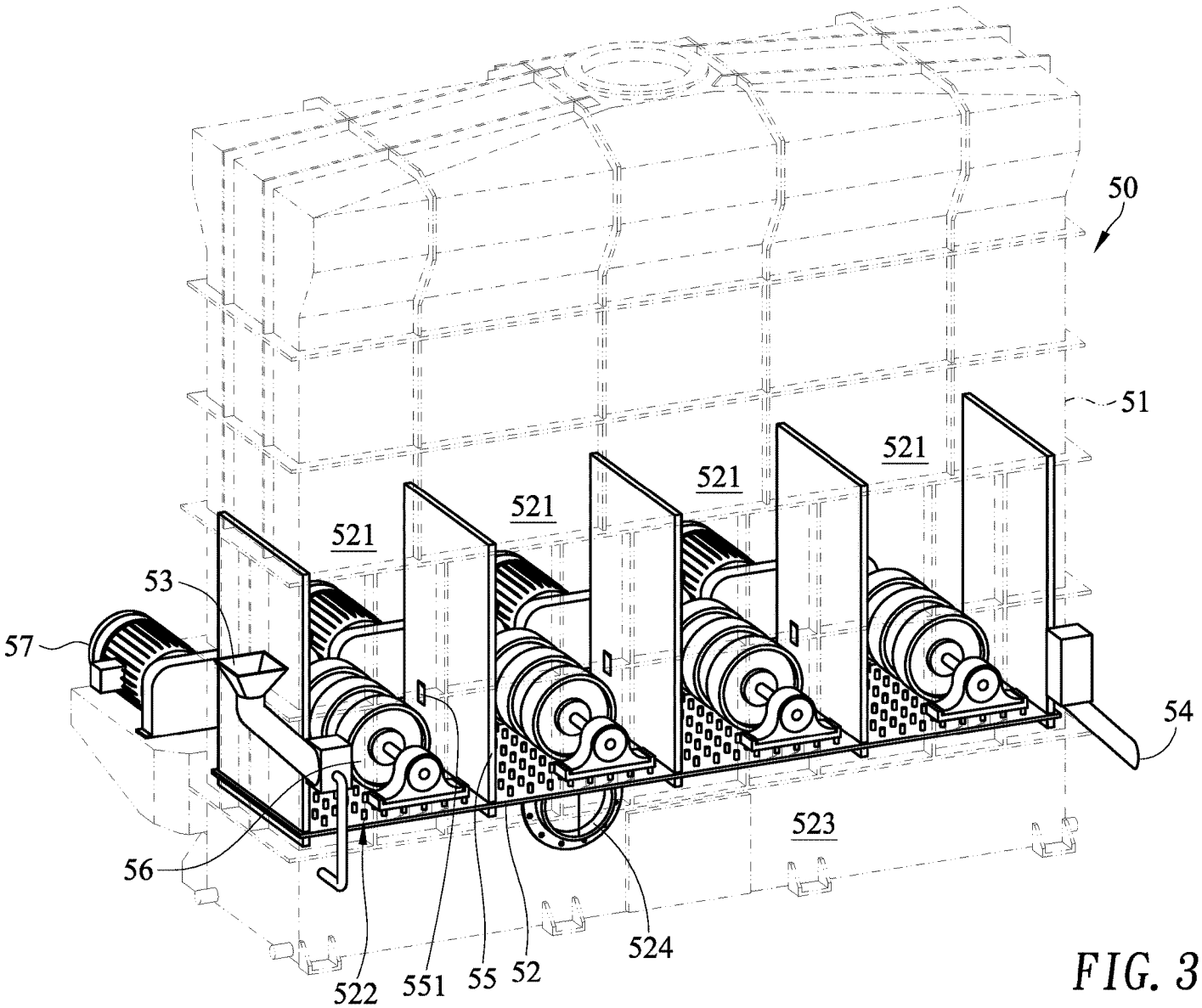
FIG. 3 is a perspective view of a grinder of the regeneration treatment system in FIG. 2.
Figure 4:
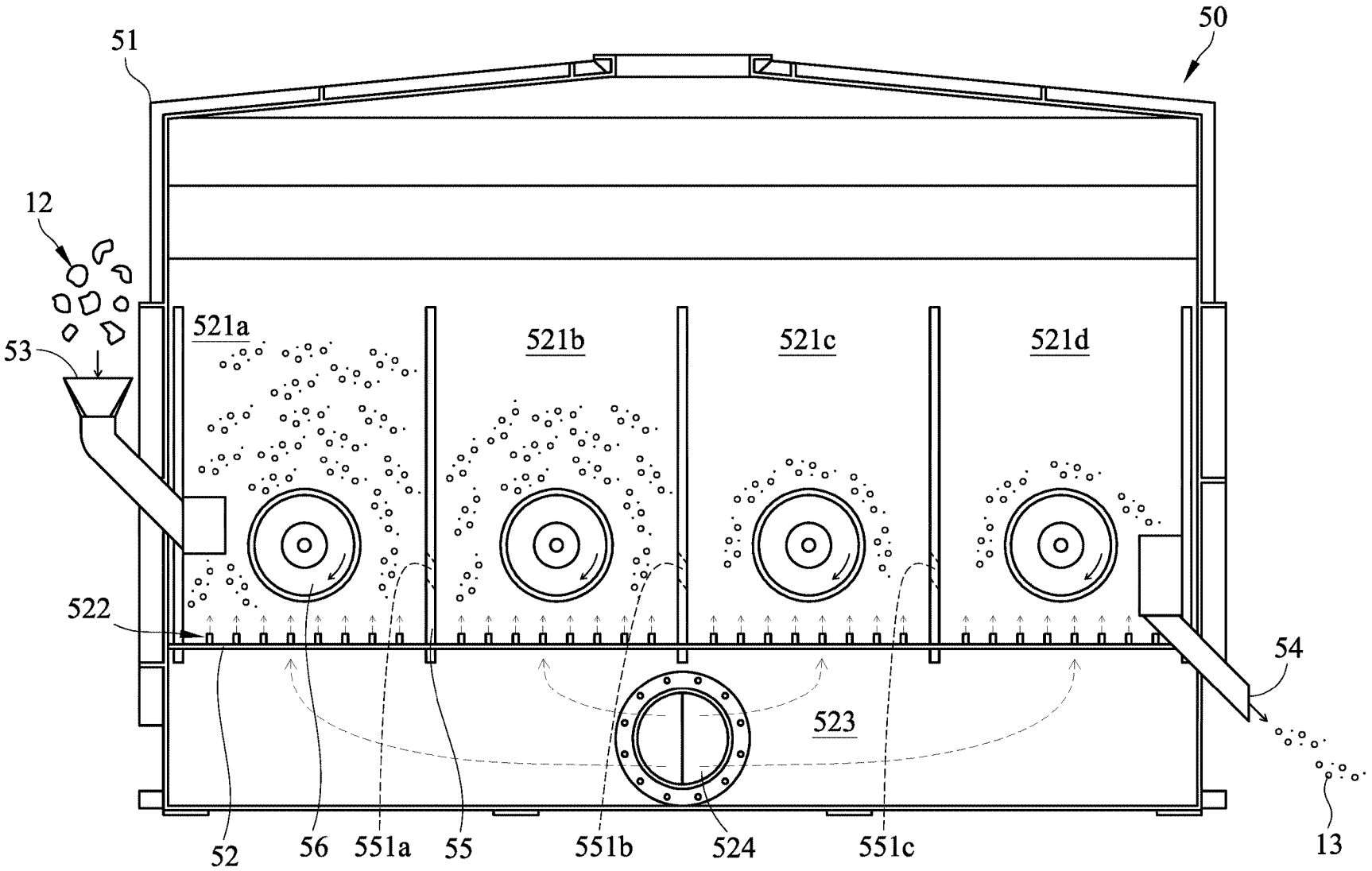
FIG. 4 is a schematic view illustrating an operation of the grinder in FIG. 3.

As shown in FIGS. 2 and 3, the grinder 50 has at least one grinding chamber 521 and receives the refined shell-mold sand 12 separated from the first magnetic separator 40. As shown in FIG. 4, the refined shell-mold sand 12 is blown upward by an ascending airflow in the at least one grinding chamber 521. The grinder 50 further has at least one roller 56 mounted in the at least one grinding chamber 521. The refined shell-mold sand 12 accommodated and floated in the at least one grinding chamber 521 is driven by the at least one roller 56 to whirl the refined shell-mold sand 12 and grind by colliding with each other. The silica binders adhered to surfaces of the refined shell-mold sand 12 are thus removed to obtain a shell-mold sand granular material 13. In one embodiment, the grinder 50 comprises four grinding chambers 521 to further grind and remove edges and corners on the surfaces of the refined shell-mold sand 12 while the silica binders are removed. Therefore, a final shape of the shell-mold sand granular material 13 is relatively round. Furthermore, since the refined shell-mold sand 12 is whirled and ground by colliding with each other in the grinding chambers 521 of the grinder 50 with a low-stress, the particle sizes of most of the refined shell-mold sand are kept in the suitable particle size range.

The second magnetic separator 60 receives the shell-mold sand granular material 13 obtained from the grinder 50. The second magnetic separator 60 generates magnetic force to remove the magnetic metal powders mixed in the shell-mold sand granular material 13. In one embodiment, the second magnetic separator 60 has an electromagnetic 61 mounted therein to provide the magnetic force to remove the magnetic metal powders, but is not limited thereto.

Figure 5:
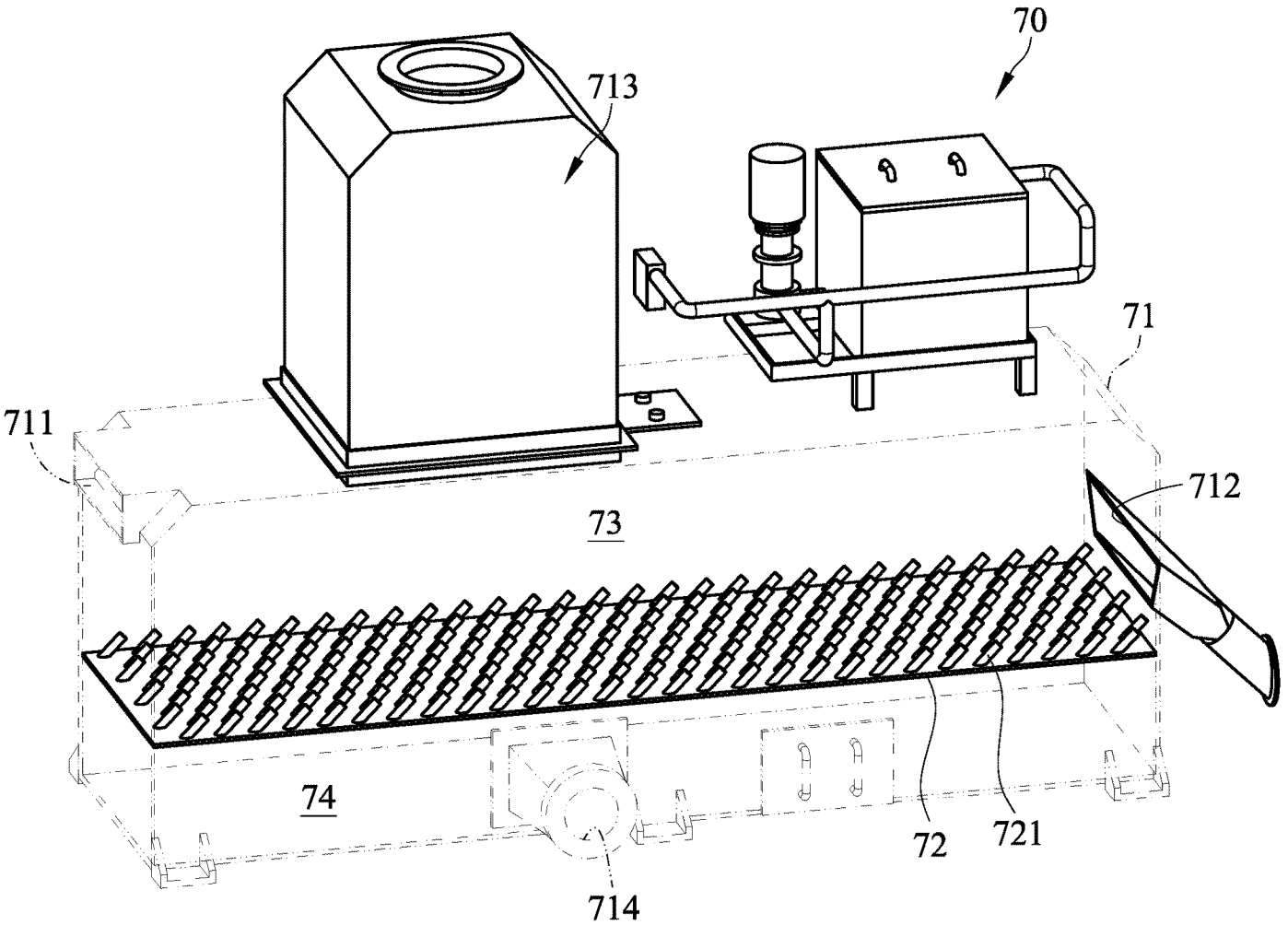
FIG. 5 is a perspective view of a dry pneumatic flotation machine of the regeneration treatment system in FIG. 2.

As shown in FIGS. 2 and 5, the dry pneumatic flotation machine 70 has a flotation chamber 73 and receives the shell-mold sand granular material 13 separated from the second magnetic separator 60. The non-magnetic impurity mixed in the shell-mold sand granular material 13 is removed during the shell-mold sand granular material 13 is blown by the airflow in the flotation chamber 73. Regenerated shell-mold sand 14 is separated from the shell-mold sand granular material 13. The non-magnetic impurity includes non-magnetic impurity particles and non-magnetic impurity powders. The regenerated shell-mold sand 14 and the non-magnetic impurity particles are separated from a difference in the density therebetween. The regenerated shell-mold sand 14 and the non-magnetic impurity powders and a difference in the particle sizes therebetween.

Figure 7:
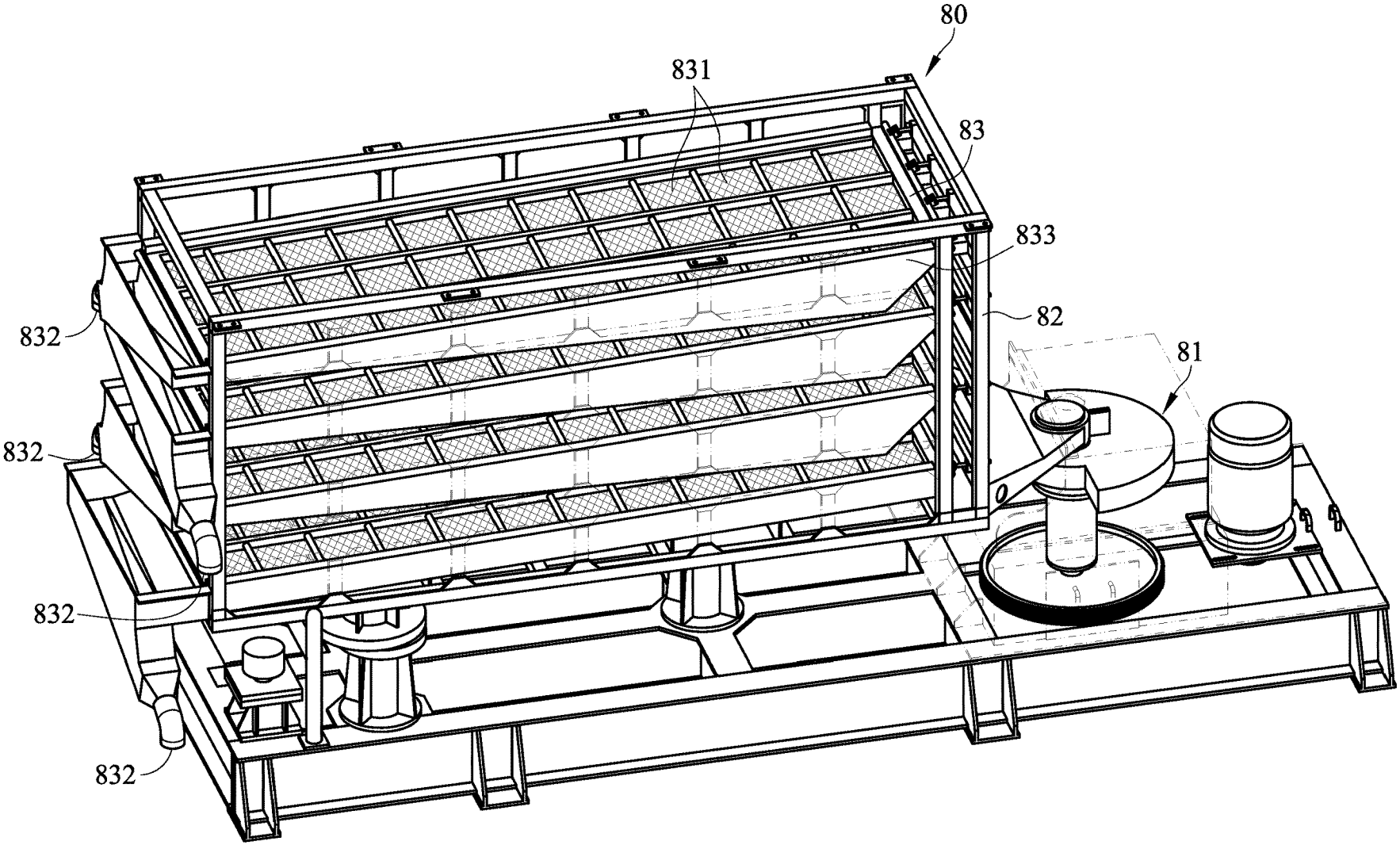
FIG. 7 is a perspective view of a rotary vibration sieving machine of the regeneration treatment system in FIG. 2.

As shown in FIGS. 2 and 7, the rotary vibration sieving machine 80 has a metal sieve 831 and receives the regenerated shell-mold sand 14 separated from the dry pneumatic flotation machine 70. The static electricity is removed during the regenerated shell-mold sand 14 rolls down on a metal sieve 831. Then, the dust adsorbed on the regenerated shell-mold sand 14 by the static electricity is removed. The regenerated shell-mold sand 14 remaining on the metal sieve 831 is collected.

In one embodiment as shown in FIGS. 3 and 4, the grinder 50 comprises a shell 51, a bottom plate 52, a refined shell-mold sand inlet 53, a shell-mold sand granular material outlet 54, the at least one roller 56, and at least one driving apparatus 57. The bottom plate 52 is mounted in the shell 51 to separate the at least one grinding chamber 521 and an airflow chamber 523. The bottom plate 52 has a plurality of airflow outlet pipes 522 communicating the at least one grinding chamber 521 with the airflow chamber 523. In one embodiment, the airflow outlet pipes 522 are mounted vertically on the bottom plate 52. The at least one grinding chamber 521 is defined on an upper side of the bottom plate 52. The airflow chamber 523 is defined on a lower side of the bottom plate 52. The shell 51 further has an airflow inlet 524 disposed on a middle segment thereof corresponding to the airflow chamber 523. The refined shell-mold sand inlet 53 is disposed on a side of the shell 51, communicates with the at least one grinding chamber 521, and is designed for the refined shell-mold sand 12 separated from the first magnetic separator 40 to be fed into the at least one grinding chamber 521. The shell-mold sand granular material outlet 54 is disposed on the of the shell 51, communicates with the at least one grinding chamber 521, and is designed for the shell-mold sand granular material 13 obtained from the grinder 50 to leave the at least one grinding chamber 521. The at least one roller 56 is mounted in the corresponding grinding chamber 521, and a distance is kept between the at least one roller 56 and the airflow outlet pipes 522 of the bottom plate 52. The at least one driving apparatus 57 is mounted on another side of the shell 51 and is connected to the corresponding roller 56 to drive the corresponding roller 56 to rotate.

In one embodiment, the grinder 50 further comprises three partitions 55. The three partitions 55 are arranged separately from each other and mounted vertically on the bottom plate 52 to define first to fourth grinding chambers 521*a*, 521*b*, 521*c*, and 521*d* with the shell 51 and the bottom plate 52. Each partition 55 has an oblique channel 551 formed through the partition 55. As shown in FIG. 4, the first grinding chamber 521*a* communicates with the second grinding chamber 521*b* through an oblique channel 551*a* inclining from the first grinding chamber 521*a* to the second grinding chamber 521*b*. In the same way, the second grinding chamber 521*b* communicates with the third grinding chamber 521*c* through an oblique channel 551*b* inclining from the second grinding chamber 521*b* to the third grinding chamber 521*c*. The third grinding chamber 521*c* communicates with the fourth grinding chamber 521*d* through an oblique channel 551*c* inclining from the third grinding chamber 521*c* to the fourth grinding chamber 521*d*. The refined shell-mold sand inlet 53 communicates with the first grinding chamber 521*a*. The shell-mold sand granular material outlet 54 communicates with the fourth grinding chamber 521*d*. An amount of the roller 56 is four and the four rollers 56 are respectively mounted in the first to fourth grinding chambers 521*a*, 521*b*, 521*c*, and 521*d*. An amount of the driving apparatus 57 is four corresponding to the four rollers 56 and the four driving apparatuses 57 are respectively connected to the four rollers 56.

A grinding operation of the grinder 50 is further introduced. As shown in FIG. 4, an airflow enters the airflow chamber 523 through the airflow inlet 524, passes through the airflow outlet pipes 522, and then blows upward to the first to fourth grinding chambers 521*a*, 521*b*, 521*c*, and 521*d*. At the same time, the refined shell-mold sand 12 separated from the first magnetic separator 40 is fed into the first grinding chamber 521*a* of the grinder 50 through the refined shell-mold sand inlet 53. Then, the refined shell-mold sand 12 is blown upward by the airflow and is floated in the first grinding chamber 521*a*. The roller 56 mounted in the first grinding chamber 521*a* is driven by the corresponding driving apparatus 57 to whirl and grind the refined shell-mold sand 12 by colliding with each other. The silica binders adhered to the surfaces of the refine shell-mold sand 12 are removed and edges and corners on the surface of the refined shell-mold sand 12 are ground and removed. When a height of the refined shell-mold sand 12 accumulated in the first grinding chamber 521*a* reaches a height of the oblique channel 551*a*, a part of the refined shell-mold sand 12 is pushed into the second grinding chamber 521*b*. The grinding operation is carried out to further remove the silica binders and the edges and corners on the surface of the refined shell-mold sand 12 thereafter. In the same way, the refined shell-mold sand 12 is further pushed into the third and fourth grinding chamber 521*c* and 521*d* to be ground. Additionally, after the refined shell-mold sand 12 is ground by the grinder 50, powders of the silica binders which are ground therefrom, slight powders of the shell-mold sand, and a small amount of the magnetic metal particles are still generated and mixed in the shell-mold sand granular material 13. Furthermore, A small part of the non-magnetic impurity particles is ground into non-magnetic impurity powders which are still mixed in the shell-mold sand granular material 13. Finally, the shell-mold sand granular material 13 without silica binders leaves the grinder 50 through the shell-mold sand granular material outlet 54.

Figure 6:
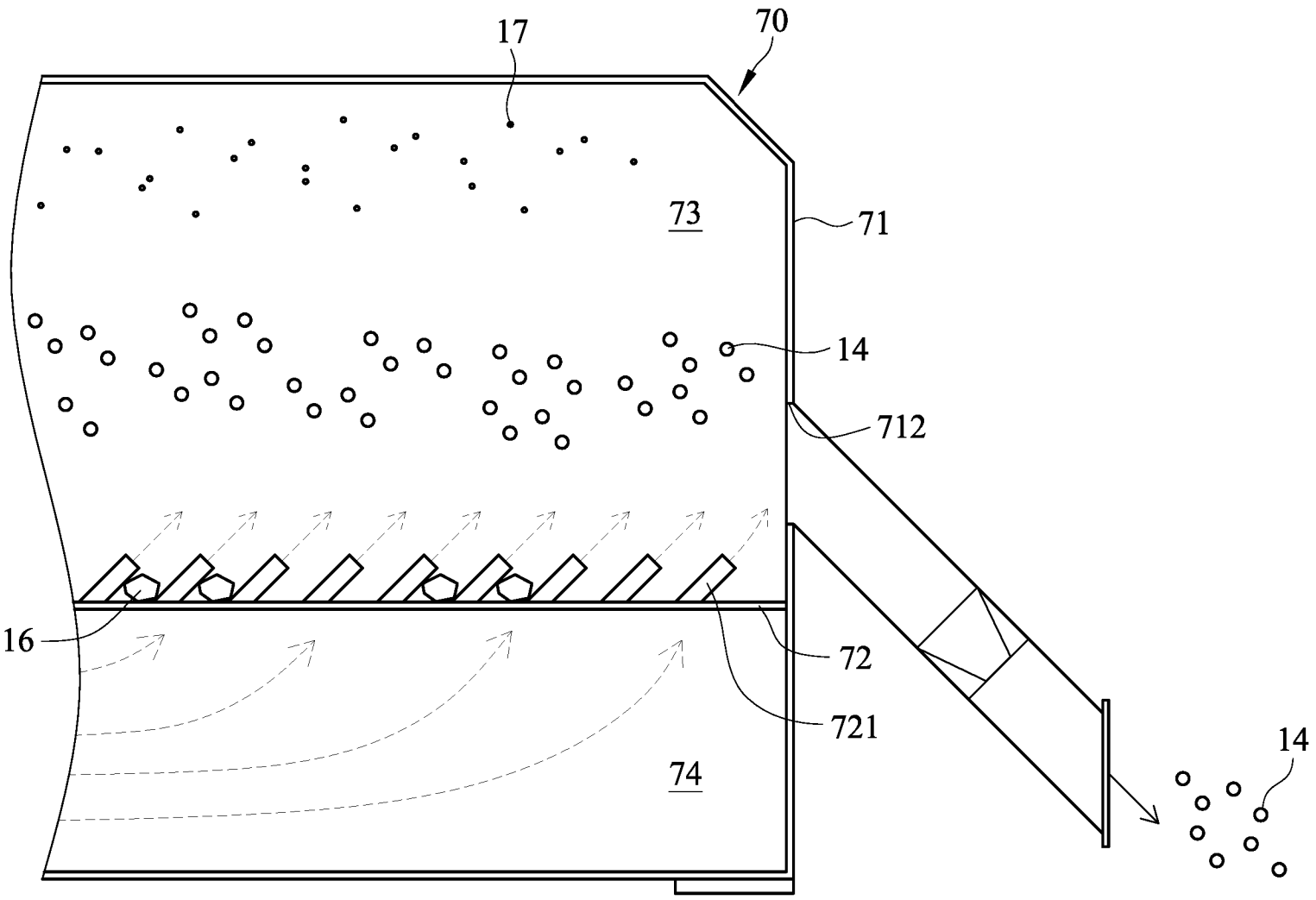
FIG. 6 is a schematic view illustrating an operation of the dry pneumatic flotation machine in FIG. 5.

In one embodiment as shown in FIGS. 5 and 6, the dry pneumatic flotation machine 70 comprises a housing 71 and a bottom board 72. The housing 71 includes a shell-mold sand granular material inlet 711 and a regenerated shell-mold sand outlet 712 respectively disposed on two opposite sides of the housing 71. The shell-mold sand granular material inlet 711 is designed for the shell-mold sand granular material separated from the second magnetic separator 60 to be fed into the dry pneumatic flotation machine 70. The regenerated shell-mold sand outlet 712 is designed for the regenerated shell-mold sand 14 to leave the dry pneumatic flotation machine 70. The bottom board 72 is mounted in the housing 71 and located at a lower side of the shell-mold sand granular material inlet 711 and the regenerated shell-mold sand outlet 712. The bottom board 72 defines the flotation chamber 73 with the housing 71. The shell-mold sand granular material inlet 711 and the regenerated shell-mold sand outlet 712 communicate with the flotation chamber 73. The shell-mold sand granular material is fed into the flotation chamber 73 through the shell-mold sand granular material 711. The regenerated shell-mold sand 14 leaves the flotation chamber 73 through the regenerated shell-mold sand outlet 712. In one embodiment, the housing 71 further has a powder collector 713 mounted on a top wall of the housing and communicating with the flotation chamber 73. The bottom board 72 has a plurality of oblique airflow outlet tubes 721 spaced from each other. The oblique airflow outlet tubes 721 extend from the bottom board 72 to the flotation chamber 73 and incline from the bottom board 72 to the regenerated shell-mold sand outlet 712. Therefore, the shell-mold sand granular material horizontally moves toward the regenerated shell-mold sand outlet 712. The non-magnetic impurity mixed in the shell-mold sand is easier to be removed and the regenerated shell-mold sand 14 separated from the shell-mold sand granular material is collected. In one embodiment, an airflow chamber 74 is defined in the housing 71, and the bottom board 72 separates the airflow chamber 74 and the flotation chamber 73. The airflow chamber 74 is defined at a lower side of the bottom board 72. The oblique airflow outlet tubes 721 communicate the airflow chamber 74 with the flotation chamber 73. The housing 71 further has an airflow inlet 714 disposed on a middle segment corresponding to the airflow chamber 74.

A flotation operation of the dry pneumatic flotation machine 70 is further introduced as follows. As shown in FIGS. 5 and 6, an airflow enters the airflow chamber 74 through the airflow inlet 714 and blows obliquely to the flotation chamber 73 through the oblique air outlet tubes 721. A pressure of the airflow may be between 4 kPa and 6 kPa. In one embodiment, the pressure of the airflow may be 5 kPa. At the same time, the shell-mold sand granular material separated from the second magnetic separator 60 is fed into the flotation chamber 73 through the shell-mold sand granular material inlet 711. In the shell-mold sand granular material, a density of the non-magnetic impurity particles 16 is greater than that of the regenerated shell-mold sand 14, so the non-magnetic impurity particles 16 is not blown by the oblique airflow. Finally, the non-magnetic impurity particles 16 fall in gaps spaced between the oblique airflow outlet tubes 721 on the bottom plate 52. Since the density and particle sizes of the regenerated shell-mold sand 14 is moderate, the regenerated shell-mold sand 14 is blown and is floated in the air to be separated and move to the regenerated shell-mold sand outlet 712. Finally, the regenerated shell-mold sand 14 leaves the dry pneumatic flotation machine 70. Since particle sizes of the non-magnetic impurity powders 17 is less than that of the regenerated shell-mold sand 14, the non-magnetic impurity powders 17 is blown away the regenerated shell-mold sand 14 and gather toward the top wall of the flotation chamber 73. Finally, the non-magnetic impurity powders 17 is sucked in the powder collector 713 to be collected and removed. The non-magnetic impurity may include the stainless steel, the titanium, or the aluminum, the zircon sand, powders of the silica binders, the slight shell-mold sand, and so on.

Figure 8:
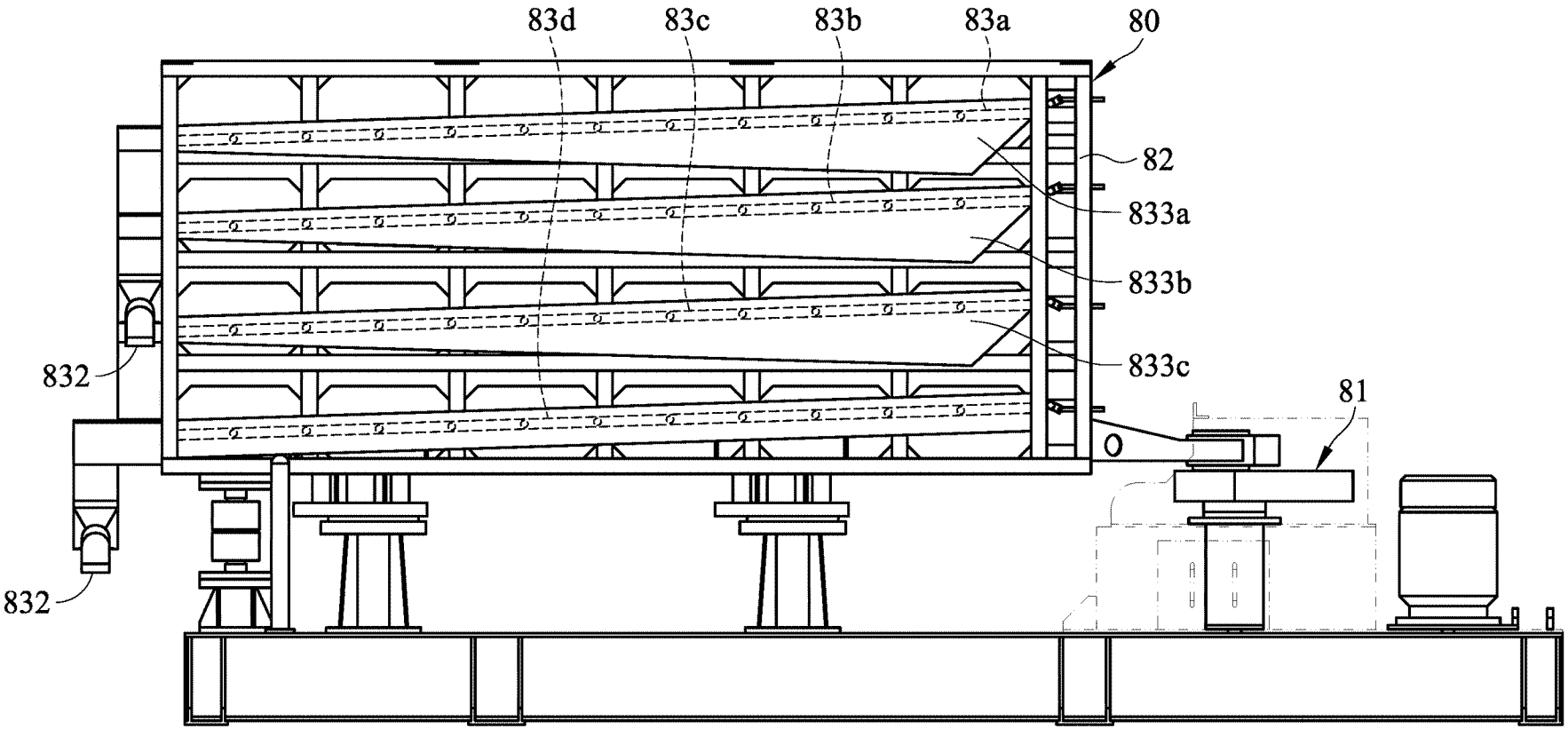
FIG. 8 is a side view of the rotary vibration sieving machine FIG. 7.
Figure 9:
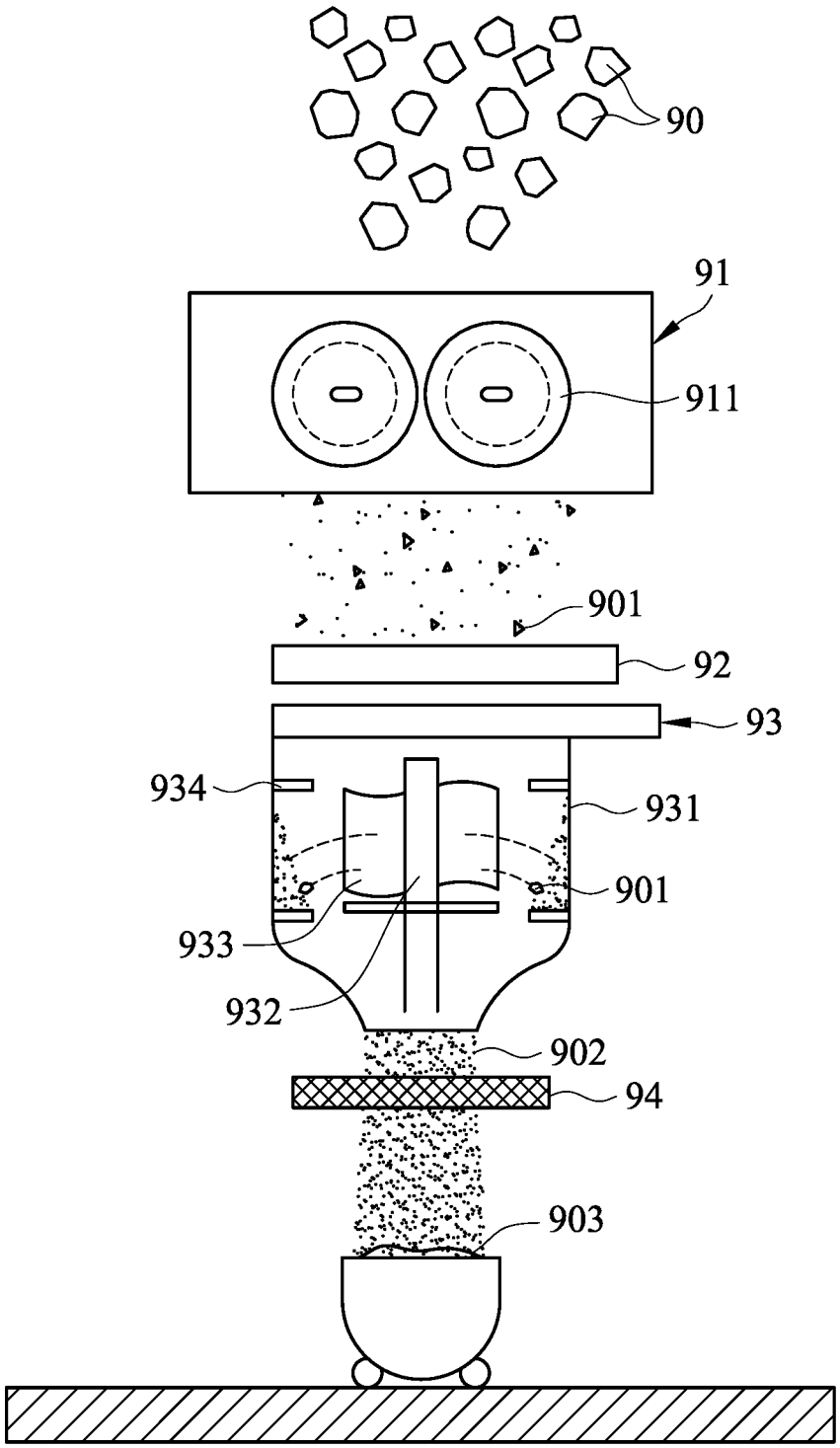
FIG. 9 (PRIOR ART)
FIG. 9 is a schematic view illustrating a conventional treatment system of waste shell-mold in accordance with the prior art.

In one embodiment as shown in FIGS. 7 and 8, the rotary vibration sieving machine 80 comprises a vibration unit 81, a framework 82, and at least one sieve frame 83. The vibration unit 81 is mounted on and is connected to an outer side of the framework 82 to vibrate the framework 82. The at least one sieve frame 83 is mounted obliquely in the framework 82 and comprises the metal sieves 831 having the same mesh sizes and a regenerated shell-mold sand outlet 832. The regenerated shell-mold sand outlet 832 is mounted on the lowest side of the sieve frame 83. In one embodiment, an amount of the at least one sieve frame 83 is four. As shown in FIG. 8, first to fourth sieve frames 83*a*, 83*b*, 83*c*, and 83*d* are mounted in the framework 82 from upside to downside. The first to fourth sieve frames 83*a*, 83*b*, 83*c*, and 83*d* tilt from a side close to the vibration unit 81 to another side away from the vibration unit 81. The first to third sieve frames 83*a*, 83*b*, and 83*c* respectively have incline hoppers 833*a*, 833*b*, and 833*c*. The inclined hoppers 833*a*, 833*b*, and 833*c* are respectively mounted on a downside of the corresponding first to third sieve frames 83*a*, 83*b*, and 83*c* and the metal sieve 81 thereof. The inclined hoppers 833*a*, 833*b*, and 833*c* tilt from a side away from the vibration unit 81 to another side close to the vibration unit 81. Each inclined hopper 833*a*, 833*b*, and 833*c* has an opening formed through a the side close to the vibration unit 83. Additionally, there is no sieve frame 83 mounted downside of the fourth sieve frame 83 so that the fourth sieve frame does not has the inclined hopper 833. The mesh sizes of the metal sieves 831 respectively mounted on the first to fourth sieve frames 83*a*, 83*b*, 83*c*, and 83*d* decrease according to the order of the first to fourth sieve frames 83*a*, 83*b*, 83*c*, and 83*d*. In one embodiment, the standard specification of the mesh sizes of the metal sieves 831 is based on the ASTM Standard Test Sieves, but is not limited thereto.

A vibration sieving operation of the rotary vibration sieving machine 80 is further introduced as follows. The vibration unit 81 vibrates the framework 82 to move the sieve frames 83 and the metal sieves 831 back and forth. At the same time, the regenerated shell-mold sand separated from the dry pneumatic flotation machine 70 is fed from above the first screen frame 83*a* and is received by the metal sieves 831. The metal sieves 831 are moved by the vibration unit 81 back and forth and the regenerated shell-mold sand rolls back and forth on the metal sieves 831. The regenerated shell-mold sand having the particle sizes greater than the mesh size of the metal sieves 831 remains on the metal sieves 831 and fully contacts with the metal sieve 831 and the sieve frame 83 made of metal. The static electricity of the regenerated shell-mold sand is removed. Then, the dust absorbed on the surfaces of the regenerated shell-mold sand by the static electricity is removed. In one embodiment, the regenerated shell-mold sand having the particle sizes that fall within a first particle size range remains on the metal sieves 831 of the first sieve frame 83*a*. The first particle size range is between the mesh size of the metal sieves 831 of the first sieve frame 83*a* and the suitable particle size range which is 6 mm. Finally, the regenerated shell-mold sand is collected by the regenerated shell-mold sand outlet 832 of the first sieve frame 83*a* and is introduced into a storage barrel.

A part of the regenerated shell-mold sand passing through the metal sieve 831 of the first to third sieve frames 83*a*, 83*b*, and 83*c* is respectively guided by the corresponding inclined hoppers 833*a*, 833*b*, and 833*c* and falls down to the side close to the vibration unit 81 of the corresponding second to fourth sieve frame 83*b*. The vibration sieving operation is carried out thereafter in the same way, that is, the regenerated shell-mold sand remaining on the metal sieves 831 of the second to fourth sieve frames 83*b*, 83*c*, and 83*d* is further collected and is respectively introduced into the corresponding storage barrel. The regenerated shell-mold sand remaining on the metal sieves 831 of the second to fourth sieve frames 83*b*, 83*c*, and 83*d* having the particle sizes within a second particle size range to a fourth particle size range. In one embodiment, average granularities of the regenerated shell-mold sand sifted out by the rotary vibration sieving machine 80 is as follows. The average granularities of the regenerated shell-mold sand having the particle sizes that fall within the first particle size range to the fourth particle size range may be 22S, 35S, 60S, and 70S respectively, but the average granularities of the regenerated shell-mold sand are not limited to the value described above.

With the foregoing description, the first magnetic separator first removes the magnetic metal particles mixed in the refined shell-mold sand. Then, the grinder effectively removes the silica binders adhered to the surfaces of the refined shell-mold sand and does not decrease the particle size of the refined shell-mold sand. At the same time, the edges and corners on the surface of the refined shell-mold sand is ground and removed to obtain the shell-mold sand granular material having rounded shape. The second magnetic separator further removes the magnetic metal powder mixed in the shell-mold sand granular material. The dry pneumatic flotation machine effectively removes the non-magnetic impurity particles and the non-magnetic impurity powders mixed in the shell-mold sand granular material. Additionally, the dry pneumatic flotation machine does not use the water and the surfactants so that the wastewater and the pollutants are not generated. Furthermore, the rotary vibration sieving machine drives the regenerated shell-mold sand to roll on the metal sieves thereof. The static electricity is removed. The dust absorbed on the surface of the regenerated shell-mold sand by the static electricity is removed. The recovery rate of the regenerated shell-mold sand is thus enhanced. The magnetic metal and the non-magnetic impurity does not residue in the obtained regenerated shell-mold sand. The air permeability of the regenerated shell-mold sand when using and the disintegration ability of the regenerated shell-mold sand after using are enhanced. Thus, the regenerated shell-mold sand may substitute the original shell-mold sand.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A regeneration treatment method of waste shell-mold comprising steps of:

(a) raw smashing waste shell-molds into raw shell-mold sand;

(b) sifting out refined shell-mold sand from the raw shell-mold sand, wherein particle sizes of the refined shell-mold sand fall within a first particle size range;

(c) removing magnetic metal particles mixed in the refined shell-mold sand;

(d) whirling and grinding the refined shell-mold sand by colliding with each other to remove silica binders adhered to surfaces of the refined shell-mold sand to obtain a shell-mold sand granular material;

(e) removing magnetic metal powders mixed in the shell-mold sand granular material;

(f) removing non-magnetic impurity mixed in the shell-mold sand granular material during the shell-mold sand granular material being blown by an airflow to separate regenerated shell-mold sand from the shell-mold sand granular material; and (g) rolling the regenerated shell-mold sand on a metal sieve to remove dust adsorbed on the regenerated shell-mold sand by the static electricity and to collect the regenerated shell-mold sand remaining on the metal sieve.

2. The regeneration treatment method of waste shell-mold as claimed in claim 1, wherein the step (d) comprises a plurality of grinding procedures.

3. The regeneration treatment method of waste shell-mold as claimed in claim 2, wherein in the step (f):

the non-magnetic impurity comprises non-magnetic impurity particles and non-magnetic impurity powders;

a density of the non-magnetic impurity particles is greater than a density of the regenerated shell-mold sand;

particle sizes of the non-magnetic impurity powders are less than particles sizes of the regenerated shell-mold sand; and when the airflow blows upward, the regenerated shell-mold sand is floated and the non-magnetic impurity powders are blown away by the airflow.

4. The regeneration treatment method of waste shell-mold as claimed in claim 2, wherein in the step (f), the airflow is an oblique airflow and the shell-mold sand granular material is moved horizontally by the oblique airflow.

5. The regeneration treatment method of waste shell-mold as claimed in claim 1, wherein in the step (f), the airflow is an oblique airflow and the shell-mold sand granular material is moved horizontally by the oblique airflow.

6. The regeneration treatment method of waste shell-mold as claimed in claim 4, wherein the step (g) comprises a plurality of vibration sieving procedures; and the vibration sieving procedures use a plurality of metal sieves with different mesh sizes, and the mesh sizes of the metal sieves are arranged from large to small according to the order in which the vibration sieving procedures are carried out.

7. The regeneration treatment method of waste shell-mold as claimed in claim 6, wherein the step (g) comprises four vibration sieving procedures and the mesh sizes of the metal sieves decrease according to the first vibration procedure to the fourth vibration procedure, wherein:

the first vibration sieving procedure collects the regenerated shell-mold sand having the particle sizes that fall within a second particle size range; wherein the second particle size range is between the mesh size of the metal sieve applied in the first vibration sieving procedure and a maximum of the first particle size range;

the second vibration sieving procedure collects the regenerated shell-mold sand having the particle sizes that fall within a third particle size range; wherein the third particle size range is between the mesh size of the metal sieve applied in the second vibration sieving procedure and the mesh size of the metal sieve applied in the first vibration sieving procedure;

the third vibration sieving procedure collects the regenerated shell-mold sand having the particle sizes that fall within a fourth particle size range; wherein the fourth particle size range is between the mesh size of the metal sieve applied in the third vibration sieving procedure and the mesh size of the metal sieve applied in the second vibration sieving procedure; and the fourth vibration sieving procedure collects the regenerated shell-mold sand having the particle sizes that fall within a fifth particle size range; wherein the third particle size range is between the mesh size of the metal sieve applied in the fourth vibration sieving procedure and the mesh size of the metal sieve applied in the third vibration sieving procedure.

8. The regeneration treatment method of waste shell-mold as claimed in claim 1, wherein the first particle size range is between 4 mm to 6 mm.

9. A regeneration treatment system of waste shell-mold comprising:

a smasher for smashing waste shell-molds into raw shell-mold sand;

a sieving machine connected to the smasher for receiving the raw shell-mold sand obtained from the smasher and for sifting out refined shell-mold sand from the raw shell-mold sand; wherein particle sizes of the refined shell-mold sand fall within a first particle size range;

a first magnetic separator connected to the sieving machine for receiving the refined shell-mold sand sifted out by the sieving machine and for removing magnetic metal particles mixed in the refined shell-mold sand;

a grinder connected to the first magnetic separator, comprising at least one grinding chamber for receiving and whirling the refined shell-mold sand, wherein the refined shell-mold sand are ground by colliding to each other in the at least one grinding chamber to remove silica binders adhered to surfaces of the refined shell-mold sand and to obtain a shell-mold sand granular material;

a second magnetic separator connected to the grinder for receiving the shell-mold sand granular material and for removing magnetic metal powders mixed in the shell-mold sand granular material;

a dry pneumatic flotation machine connected to the second magnetic separator, comprising a floatation chamber for receiving the shell-mold sand granular material, for removing non-magnetic impurity particles mixed in the shell-mold sand granular material, and for blowing away non-magnetic impurity powders mixed in the shell-mold sand granular material by an airflow in the flotation chamber to obtain regenerated shell-mold sand; and a rotary vibration sieving machine connected to the dry pneumatic flotation machine, comprising a metal sieve for receiving the regenerated shell-mold sand, and for rolling the regenerated shell-mold sand on the metal sieve to remove dust adsorbed on the regenerated shell-mold sand by the static electricity and to collect the regenerated shell-mold sand remaining on the metal sieve.

10. The regeneration treatment system of waste shell-mold as claimed in claim 9, wherein the smasher is a drum type smasher having a smashing drum comprises:

a waste shell-mold inlet designed for the waste shell-molds to be fed into the smashing drum; and a raw shell-mold sand outlet designed for the raw shell-mold sand to leave the smashing drum; wherein a direction of an opening of the waste shell-mold inlet and a direction of an opening of the raw shell-mold sand outlet are vertical to each other.

11. The regeneration treatment system of waste shell-mold as claimed in claim 10, wherein the rotary vibration sieving machine further comprises:

a framework;

a vibration unit mounted on and connected to an outer side of the framework; and at least one sieve frame mounted obliquely in the framework and comprising a plurality of metal sieves having the same mesh size and a regenerated shell-mold sand outlet mounted on the lowest side of the at least one sieve frame.

12. The regeneration treatment system of waste shell-mold as claimed in claim 9, wherein the sieving machine has a perforated sieve plate.

13. The regeneration treatment system of waste shell-mold as claimed in claim 9, wherein the grinder further comprises:

a shell;

a bottom plate mounted in the shell, defining the at least one grinding chamber with the shell, and having a plurality of airflow outlet pipes mounted vertically on the bottom plate;

a refined shell-mold sand inlet mounted on the shell, communicating with the at least one grinding chamber, and designed for the refined shell-mold sand separated from the first magnetic separator to be fed into the at least one grinding chamber;

a shell-mold sand granular material outlet mounted on the shell, communicating with the at least one grinding chamber for the shell-mold sand granular material to leave the at least one grinding chamber;

at least one roller mounted in the corresponding at least one grinding chamber; wherein a distance is kept between the at least one roller and the corresponding airflow outlet tubes of the bottom plate; and at least one driving apparatus mounted on a side of the shell and connecting to the corresponding at least one roller to drive the corresponding at least one roller to rotate.

14. The regeneration treatment system of waste shell-mold as claimed in claim 13, wherein:

an airflow chamber is defined in the shell; wherein the bottom plate separates the airflow chamber and the at least one grinding chamber, and the airflow outlet tubes communicate the at least one grinding chamber with the airflow chamber; and the shell has an airflow inlet disposed on a middle segment of the shell corresponding to the airflow chamber.

15. The regeneration treatment system of waste shell-mold as claimed in claim 14, wherein:

the grinder further comprises three partitions arranged separately from each other and mounted vertically on the bottom plate to define a first grinding chamber, a second grinding chamber, a third grinding chamber and a fourth grinding chamber with the shell and the bottom plate; wherein each partition has an oblique channel and the oblique channels communicate the first to fourth grinding chambers with each other;

the refined shell-mold sand inlet communicates with the first grinding chamber;

the shell-mold sand granular material outlet communicates with the fourth grinding chamber;

an amount of the at least one roller is four, and the four rollers are respectively mounted in the first grinding chamber to the fourth grinding chamber; and an amount of the at least one driving apparatus is four, and the four driving apparatuses are respectively connected to the four rollers.

16. The regeneration treatment system of waste shell-mold as claimed in claim 9, wherein the dry pneumatic flotation machine further comprises:

a housing comprising a shell-mold sand granular material inlet and a regenerated shell-mold sand outlet respectively mounted on two opposite sides of the housing; wherein the shell-mold sand granular material separated from the second magnetic separator is fed into the flotation chamber through the shell-mold sand granular material inlet and the regenerated shell-mold sand leaves the flotation chamber through the regenerated shell-mold sand outlet;

a bottom board mounted in the housing, located at a lower side of the shell-mold sand granular material inlet and the regenerated shell-mold sand outlet, and having a plurality of oblique air outlet tubes spaced with each other, extending from the bottom board to the flotation chamber, and inclining toward the outlet of the housing from the bottom board;

the bottom board defines the flotation chamber with the housing; and the shell-mold sand granular material inlet and the regenerated shell-mold sand outlet communicate with the flotation chamber.

17. The regeneration treatment system of waste shell-mold as claimed in claim 16, wherein:

an airflow chamber is defined in the housing; wherein the bottom board separates the airflow chamber and the flotation chamber, and the oblique air outlet tubes communicate the flotation chamber with the airflow chamber; and the housing of the dry pneumatic flotation machine comprises:

an airflow inlet disposed on a middle segment of the housing corresponding to the air chamber; and a powder collector disposed on the housing and communicating with the flotation chamber.

18. The regeneration treatment system of waste shell-mold as claimed in claim 9, wherein the rotary vibration sieving machine further comprises:

a framework;

a vibration unit mounted on and connected to an outer side of the framework; and at least one sieve frame mounted obliquely in the framework and comprising a plurality of metal sieves having the same mesh size and a regenerated shell-mold sand outlet mounted on the lowest side of the at least one sieve frame.

19. The regeneration treatment system of waste shell-mold as claimed in claim 18, wherein:

an amount of the at least one sieve frame is four; wherein first to fourth sieve frames are mounted in the framework from upside to downside and the first to the fourth sieve frames tilt from a side close to the vibration unit to another side away from the vibration unit;

the first to the third sieve frames respectively have an inclined hopper;

the inclined hoppers are respectively mounted on a downside of the corresponding first to third sieve frames and the metal sieve thereof;

the inclined hoppers inclining from a side far from the vibration unit to another side close to the vibration unit, and has an opening formed on the side close to the vibration unit; and the mesh sizes of the metal sieves respectively mounted on the first to the fourth sieve frames decrease according to the order of the first to fourth sieve frames.

20. The regeneration treatment system of waste shell-mold as claimed in claim 9, wherein the first magnetic separator has an electromagnetic mounted therein; and the second magnetic separator has an electromagnetic mounted therein.

* * * * *